US005156251A

United States Patent [19]

Johnson

[11] Patent Number: 5,156,251

[45] Date of Patent: Oct. 20, 1992

[54] BALUSTRADE MOUNTING ASSEMBLY FOR ESCALATOR OR MOVING WALKWAY

[75] Inventor: Gerald E. Johnson, Farmington, Conn.

[73] Assignee: Otis Elevator Company, Farmington, Conn.

[21] Appl. No.: 864,756

[22] Filed: Apr. 7, 1992

[51] Int. Cl.[5] ..... B66B 23/22

[52] U.S. Cl. ..... 198/335

[58] Field of Search ..... 198/335, 333; 52/208

[56] References Cited

U.S. PATENT DOCUMENTS

| | | | |
|---|---|---|---|
| 3,926,296 | 12/1975 | Woodling et al. | 198/16 R |
| 3,991,877 | 11/1976 | Kraft et al. | 198/335 |
| 4,159,758 | 7/1979 | Courson | 198/335 |
| 4,627,527 | 12/1986 | Saito | 198/335 |
| 4,646,907 | 3/1987 | Streibig et al. | 198/335 |
| 4,690,264 | 9/1987 | Adrian et al. | 198/335 |
| 4,819,781 | 4/1989 | Saito et al. | 198/335 |
| 4,842,122 | 6/1989 | Van Nort | 198/335 |

*Primary Examiner*—D. Glenn Dayoan
*Attorney, Agent, or Firm*—William W. Jones

[57] ABSTRACT

The balustrade of an escalator or moving walkway is mounted on a conveyor truss via a plurality of anchor brackets which are welded to the truss at spaced apart locations thereon. Template brackets are secured to each anchor bracket to define the location of the balustrade clamps. The balustrade clamps employ a pivoting wedging action to lock the balustrade in place in its support channel. The assembly can be easily erected in the field and readily serviced.

5 Claims, 1 Drawing Sheet

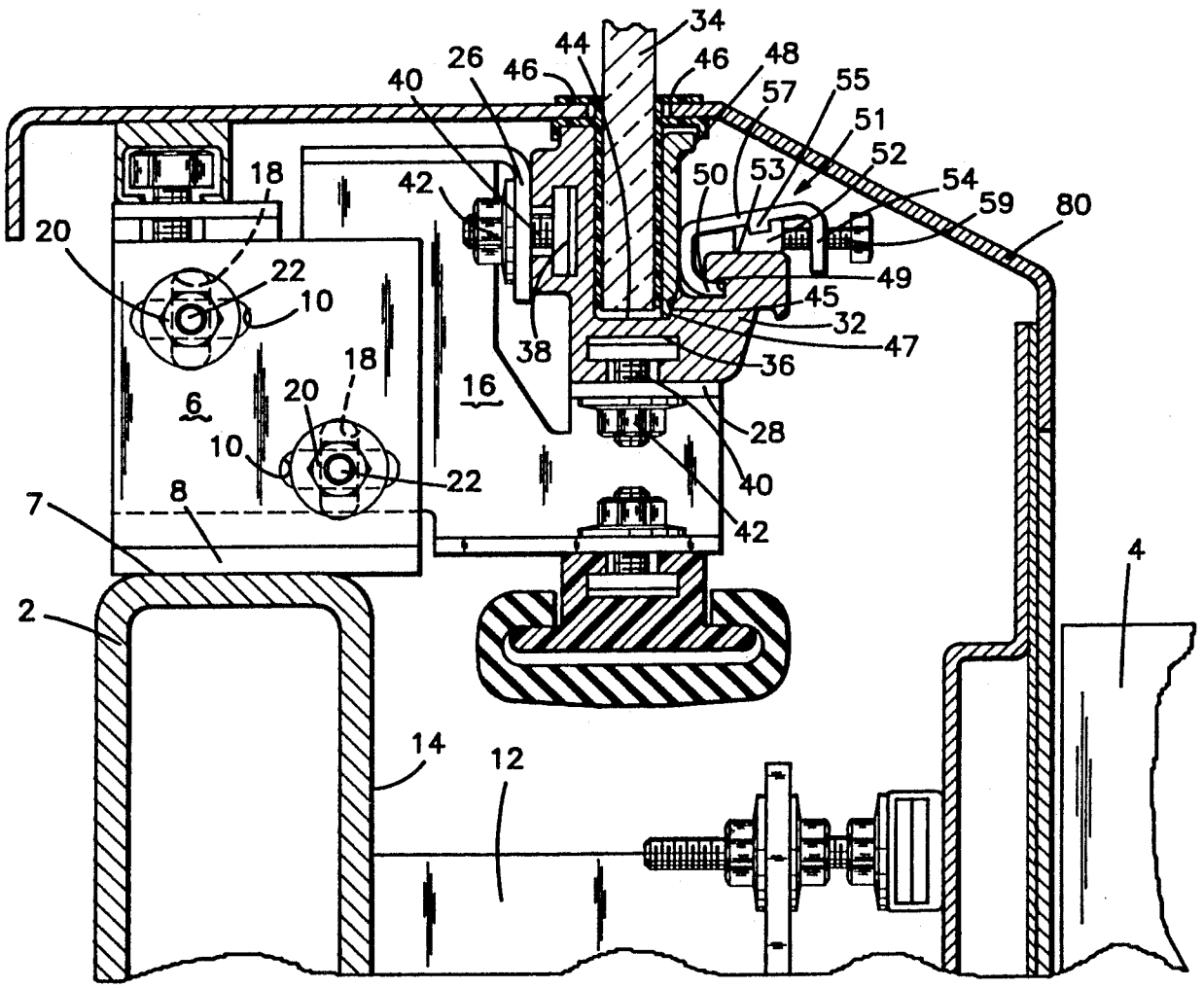
4
80
59
54
52
51
55
48
57
53
50
34
46
44
46
26
40
42
38
49
47
32
45
36
28
40
42
16
22
18
20
10
10
22
18
20
6
8
7
2
14
12

BALUSTRADE MOUNTING ASSEMBLY FOR ESCALATOR OR MOVING WALKWAY

TECHNICAL FIELD

This invention relates to an improved mounting assembly for the balustrade panels on an escalator or moving walkway. This invention is related to a mount assembly disclosed in commonly owned copending application Ser. No. 864,755 filed Apr. 7, 1992.

BACKGROUND ART

Modern streamlined escalators and moving walkways are provided with slim balustrades formed from a sheet material, usually glass. The glass balustrades are held in place by mounting assemblies which are disposed beneath the side decks of the escalator or the like. These mounting assemblies will typically include some sort of channel member in which the bottom of the balustrade rests. The balustrade will be secured to the channel or channels with drilled through nut-bolt assemblies, or with adhesives, or with some sort of clamping device. The channel can be a relatively long extruded metal member, or it can be made up of a number of short separate clamps which are spaced along the bottom edge of the balustrade. The balustrade-supporting channel or channels will be somehow tied into the truss of the structure, and will also provide the anchoring points for the inner and outer decks which flank the steps or treads on the escalator or the like. Finally, the handrail return guides which guide movement of the handrails along their return path of travel have also been anchored to the balustrade-supporting channel or channels.

The mounting systems of the prior art have two drawbacks which relate to the location of the handrail, and the accessibility of the various mounting components for installation, servicing, repair and the like from outside of the decks. It will be appreciated that the mounting systems are buried beneath the decks, and accessibility for servicemen is of paramount importance. U.S. Pat. Nos. 3,926,296 granted Dec. 16, 1975 to G.L. Woodling et al; 3,991,877 granted November 16, 1976 to J.K. Kraft, et al; 4,646,907 granted Mar. 3, 1987 to K. Streibig, et. al; 4,690,264 granted Sep. 1, 1987 to W. Adrian, et al; and 4,819,781 granted Apr. 11, 1989 to C. Saito, et al. are all illustrative of prior art glass balustrade and deck mounting systems of the type described above. It would be highly desirable to provide a mounting assembly of the type described above wherein the balustrade support channel and clamps are located at about the same level as, and close to the inner deck panel, while being free of obstructions, so that the clamps can be easily reached, and can be manipulated without having to dismantle the entire inner skirt structure.

DISCLOSURE OF THE INVENTION

This invention relates to an escalator or the like balustrade mount assembly which provides solid balustrade support. The assembly is fastened to the escalator truss, and can be easily and quickly assembled, serviced and repaired in the field since the mounting components are all positioned in close proximity with the inner decks. The connections with the truss for the handrail and balustrade are made by anchor brackets which are welded to the truss at spaced apart locations therealong outboard of the location of the balustrade. The inner skirt panels are also secured to the truss through the use of anchor brackets welded to the truss at locations outboard of the location of the balustrade. The mounts which connect the handrail guides and the balustrade support channel with the anchor brackets are template brackets that are adjustably bolted to the anchor brackets and that include bolting flanges which provide sites for automatically locating and fastening the handrail guides and the balustrade channel in place. The balustrade support channel and the handrail return guides, as well as the outer deck fastenings are all mounted on the template brackets. The inner side skirts which flank the steps are mounted on anchor brackets which are disposed below the return path of travel of the handrail. The inner deck panels are mounted in a plastic gasket which is carried in the balustrade support channel. This latter panel can be easily removed to provide open access to the balustrade support channel. The balustrade support channel uses wedging brackets and associated blocks to clamp a plate against the balustrade and the support channel, to secure the balustrade plates in place.

It is therefore an object of this invention to provide a mounting assembly for an escalator or the like balustrade components.

It is a further object of this invention to provide a mounting assembly of the character described which includes mounting components for installation, service, repair and replacement.

BRIEF DESCRIPTION OF THE DRAWING

These and other objects and advantages of the invention will become more readily apparent from the following detailed description of a preferred embodiment thereof when taken in conjunction with the accompanying drawing which is a fragmented sectional view of the mounting assembly of the invention.

BEST MODE FOR CARRYING OUT THE INVENTION

Referring to the drawing, the escalator or moving walkway includes a supporting truss, a portion of which is designated by the numeral 2, on which all of the components of the invention are mounted. The escalator steps are shown schematically at 4. It will be understood that the truss component 2 extends for the length of the escalator and is generally parallel, or equispaced from the path of travel of the steps 4. The truss component 2 is thus a beginning reference basis for the locations of the remaining components of the invention. A plurality of first anchor brackets 6 are welded to the top surface 7 of the truss component 2 at spaced apart points along the length of the .latter. The brackets 6 are generally L-shaped and include a basal flange 8 which serves as the weld site. The brackets 6 are provided with a pair of laterally elongated holes 10. A plurality of second anchor brackets 12 are also welded to the inner side surface 14 of the truss component 2 at spaced apart locations, and extend toward the steps 4.

Each of the anchor brackets 6 has a template bracket 16 bolted thereto. The template brackets 16 are provided with vertically elongated holes 18 which are matched with the holes 10 on the anchor brackets 6. Nuts and bolts 20, 22 are used to secure the two brackets 6 and 16 after proper positioning is achieved. The template brackets 16 are provided with flanges 26 and 28 which serve as anchoring sites for the balustrade support channel 32. The support channel 32 is preferably an extruded aluminum member, which in a typical escalator assembly will be about thirteen feet long in the incline, and which provides full support for the glass balustrade panels 34. The channel 32 is formed with a lower T-shaped slot 36 and an outer side T-shaped slot 38. Bolts 40 and lock nuts 42 are operable to fasten the support channel 32 to the template bracket flanges 26 and 28 thereby providing bi-directional stability to the support channel 32. An upwardly open slot 44 is formed in the support channel 32 for reception of the balustrade panels 34. Plastic liners 46 are positioned in the slot 44 on either side of the balustrade panels 34 to provide increased frictional gripping of the balustrade panels 34. A metal clamping plate 48 is disposed inside of the slot 44 and sandwiched between the liner 46 and an inner angled side wall 45 of the support channel slot 44.

The bottom edge 47 of the plate 48 is tapered to match the angle of taper of the slot side wall 45 so that when a lateral force is applied to the plate 48, to urge it toward the balustrade 34, the upper end of the plate 48 will tend to pivot in the counterclockwise direction against the balustrade 34. The inner side of the support channel 32 is provided with an undercut recess 49 which receives one end 50 of a generally U-shaped clamping bracket 51. A wedge block 52 is movably mounted on an upper surface 53 of the support channel 32, and a lock bolt 59 is threaded through a tapped bore in a downwardly depending leg 54 of the clamping bracket 51. The bracket 51 has a pair of downwardly depending tabs 55 which hold the wedge block 52 in place on the surface 53 and guide movement of the wedge block 52 toward and away from the balustrade 34. It will be noted that the medial web 57 of the bracket 51 and the upper surface of the wedge block 52 have complimentary downwardly and outwardly inclined tapers. When the bolt 59 is tightened against the wedge block 52, the clamping bracket 51 is pivoted about its end portion 50 and forced against the plate 48. The upper end of the plate 48 is thus pivoted against the liner 46 by reason of the angled surfaces 45 and 47, and the balustrade 34 is locked into the groove 44. It will be noted that the bolts 59 are easily accessible from the step side when the inner deck panel 80 is removed from the escalator or walkway.

It will be readily appreciated that the assembly can be erected in the field when new equipment is being installed, and that all of the anchoring sites on the brackets are readily accessible with the inner and outer deck panels removed. When new equipment is being erected in the field, the deck panels will be the last elements of all those shown in the drawing to be secured in place. It will be noted that the area beneath the inner deck panel is completely free of obstructions so that the balustrade clamping bolts can be easily reached by a service person once the inner deck panel is removed. There is very little chance of injuring one's hands working in this area, and full maneuverability of wrenches or other tools is easily achieved.

Since many changes and variations of the disclosed embodiment of the invention may be made without departing from the inventive concept, it is not intended to limit the invention otherwise than as required by the appended claims.

What is claimed is:

1. A balustrade mounting assembly for escalators or moving walkways, said assembly comprising:

a) a balustrade support channel connected to a truss portion of the escalator or walkway, said channel having a slot in which a bottom edge of said balustrade is positioned; said slot having an open side facing the passenger conveying portion of the escalator or moving walkway; said channel further having a lateral recess formed therein which faces the open side of the slot, and an upper surface disposed above said recess and extending toward said passenger conveying portion;

b) a clamping plate closing said open side of said support channel slot, said clamping plate being interposed between said balustrade and said lateral recess;

c) means for rocking said closing said open side of said support channel toward said balustrade upon application of a laterally directed force to an inner side of said clamping plate facing away from said balustrade;

d) a wedge bracket mounted on said support channel, said wedge bracket engaging said inner side of said clamping plate and being pivotable thereagainst about said lateral recess by reason of said wedge bracket being hooked into said lateral recess; and e) means accessible from said passenger conveying portion for selectively pivoting said wedge bracket about said lateral recess and against said clamping plate to rock said clamping plate into clamping engagement with said balustrade.

2. The mounting assembly of claim 1 wherein said means accessible includes a wedge block disposed on said upper surface of said support channel adjacent to said wedge bracket, and means for moving said wedge block toward and against said wedge bracket.

3. The mounting assembly of claim 2 wherein said wedge block is disposed beneath a medial portion of said wedge bracket, and said means for moving comprises a bolt threaded through a depending leg of said wedge bracket and engaging a side of said wedge block facing away from said clamping plate, whereby tightening of said bolt onto said wedge bracket leg forces said wedge block against said wedge bracket.

4. The mounting assembly of claim 3 wherein said wedge bracket comprises means for maintaining alignment of said wedge block on said upper surface of said support channel.

5. The mounting assembly of claim 3 further comprising an inner deck panel extending from said support channel toward said passenger conveying portion, said bolt being disposed immediately beneath said deck panel so as to be readily accessible upon removal of said deck panel from the assembly.

* * * * *